US007417604B2

(12) United States Patent
Kim

(10) Patent No.: US 7,417,604 B2
(45) Date of Patent: Aug. 26, 2008

(54) METHOD AND APPARATUS FOR DRIVING PLASMA DISPLAY PANEL

(75) Inventor: Dai Hyun Kim, Goonpo-si (KR)

(73) Assignee: LG Electronics Inc., Seoul (KR)

( * ) Notice: Subject to any disclaimer, the term of this patent is extended or adjusted under 35 U.S.C. 154(b) by 496 days.

(21) Appl. No.: 10/825,663

(22) Filed: Apr. 16, 2004

(65) Prior Publication Data

US 2004/0207571 A1 Oct. 21, 2004

(30) Foreign Application Priority Data

Apr. 17, 2003 (KR) ..... 10-2003-0024461

(51) Int. Cl.
*G09G 3/28* (2006.01)
*G09G 3/10* (2006.01)

(52) U.S. Cl. ..... 345/63; 345/67; 345/60; 315/169.4

(58) Field of Classification Search ..... 345/60–68, 345/690–692; 315/169.1–169.4
See application file for complete search history.

(56) References Cited

U.S. PATENT DOCUMENTS 6,646,625 B1 * 11/2003 Shigeta et al. ..... 345/63
6,714,250 B1 * 3/2004 Correa et al. ..... 348/447

FOREIGN PATENT DOCUMENTS

CN 1263332 A 8/2000

OTHER PUBLICATIONS

Chinese Office Action dated Jul. 27, 2007 (English full text).

* cited by examiner

*Primary Examiner*—Bipin Shalwala
*Assistant Examiner*—Steven E Holton
(74) *Attorney, Agent, or Firm*—Ked & Associates LLP

(57) ABSTRACT

A method and an apparatus for driving a plasma display panel with improved image quality are provided. The method for driving a PDP includes: determining whether a frame period is varied on the basis of order of an inputted vertical synchronization signal; varying the frame period; and shifting and arranging the first and second frames in the varied frame period.

25 Claims, 10 Drawing Sheets

METHOD AND APPARATUS FOR DRIVING PLASMA DISPLAY PANEL

BACKGROUND OF THE INVENTION

1. Field of the Invention

The present invention relates to a method and an apparatus for driving a plasma display panel, and more particularly, to a method and an apparatus for driving a plasma display panel with improved image quality.

2. Description of the Related Art

Plasma display panel (PDP) generally displays an image including character or graphic by exciting phosphor using ultraviolet rays with a wavelength of 147 nm, which is generated during a gas discharge of an inert mixed gas, such as He+Xe, Ne+Xe, He+Ne+Xe or the like. This PDP is easy to make slim and large-sized, and provides a greatly improved picture quality owing to the recent technology development. In particular, three-electrode alternating current (AC) surface discharge type PDP has advantages of a low voltage operation and a long life since wall charges stored on a surface in the course of discharge protect electrodes from sputtering caused by the discharge.

FIG. 1 is a view illustrating a discharge cell of a related art three-electrode alternating current (AC) surface discharge type plasma display panel.

Referring to FIG. 1, a discharge cell of the three-electrode AC surface discharge type PDP includes a scan electrode (Y) and a sustain electrode (Z) formed on an upper substrate 10, and an address electrode (X) formed on a lower substrate 18. Each of the scan electrode (Y) and the sustain electrode (Z) includes transparent electrodes 12Y and 12Z, and metal bus electrodes 13Y and 13Z. The metal bus electrodes 13Y and 13Z have line widths narrower than the transparent electrodes 12Y and 12Z, and are formed at one-sided edge regions of the transparent electrodes 12Y and 12Z.

The transparent electrodes 12Y and 12Z are generally formed of Indium-Tin-Oxide (Hereinafter, referred to as "ITO") on the upper substrate 10. The metal bus electrodes 13Y and 13Z are generally formed of chromium (Cr) on the transparent electrodes 12Y and 12Z to reduce a voltage drop caused by the transparent electrodes 12Y and 12Z having a high resistance. An upper dielectric layer 14 and a passivation film 16 are stacked on the upper substrate 10 having the scan electrode (Y) and the sustain electrode (Z) formed in parallel with each other. The wall charge generated at the time of plasma discharge is stored in the upper dielectric layer 14. The passivation film 16 prevents the upper dielectric layer 14 from being damaged due to the sputtering generating at the time of the plasma discharge and also, enhances an emission efficiency of secondary electrons. Magnesium oxide (MgO) is generally used as the passivation film 16. A lower dielectric layer 22 and a barrier rib 24 are formed on the lower substrate 18 having the address electrode (X), and a phosphor layer 26 is coated on a surface of the lower dielectric layer 22 and the barrier rib 24. The address electrode (X) is formed in a direction of crossing with the scan electrode (Y) and the sustain electrode (Z). The barrier rib 24 is formed in parallel with the address electrode (X) to prevent the visible ray and the ultraviolet ray caused by the discharge from being leaked to an adjacent discharge cell. The phosphor layer 26 is excited by the ultraviolet ray generated due to the plasma discharge to radiate any one visible ray of red, green or blue. The inert mixed gas for the discharge such as He+Xe, Ne+Xe, He+Ne+Xe and the like is injected into a discharge space of the discharge cell provided between the upper/lower substrates 10 and 18 and the barrier rib 24.

In such a three-electrode AC surface discharge type PDP, one frame is divided into several sub-fields having different light-emitting frequencies so as to embody a gray level of the image. Each of the sub-fields is divided into a reset period in which discharges are uniformly caused, an address period in which a discharge cell is selected, and a sustain period in which the gray level is embodied according to the discharging frequencies.

For example, in case that the image is represented using a 256-gray level as in FIG. 2, a frame period (16.67 ms) corresponding to 1/60 second is divided into eight sub-fields (SF1 to SF8). Also, each of the eight sub-fields (SF1 to SF8) is again divided into a reset period, an address period and a sustain period. Herein, the reset and address periods of each sub-field are identical to each other in every sub-field, whileas the sustain period is increased in a ratio of $2^n$ (n=0, 1, 2, 3, 4, 5, 6, 7) at each of the sub-fields. Different brightness weights of every sub-field can be combined to embody a predetermined gray level.

The conventional PDP can control the number of sustain pulses according to average picture level (hereinafter, referred to as APL) so as to uniformly deal with consumption power.

FIG. 3 is a graph showing the number of sustain pulses according to a general APL.

Referring to FIG. 3, since the brightness is determined according to the number of the sustain pulses in a PDP, if the number of all the sustain pulses of the case that average brightness is dark is identical to that of the case that average brightness is bright, problems occurs such as image quality deterioration, excessive power consumption, panel damage and the like. For example, when the number of the sustain pulses is set to be too small for all input images, contrast is reduced. In addition, when the number of the sustain pulses is set to be too large for all input images, even a dark image gets brighter and contrast is improved but the power consumption gets larger and the temperature of the panel gets higher, so that the panel may be damaged. Accordingly, it is necessary to properly adjust the number of all the sustain pulses according to the average brightness of an input image. Herein, the number of the sustain pulses increases dramatically within the gray level range in which the APL is relatively low as FIG. 3 and the number of the sustain pulses decreases within the high gray level range. Accordingly, the number of the sustain pulses increases dramatically within the gray level range in which the APL is relatively low.

FIG. 4 shows a voltage waveform in a conventional method of driving a PDP.

Referring to FIG. 4, the PDP is operated with a reset period RPD in which entire screen is initialized, an address period APD in which a cell is selected, and a sustain period in which the discharge of the selected cell is sustained.

In reset period RPD, a ramp-up signal is simultaneously applied to all the scan electrodes (Y) in a set-up duration. Small discharge is caused in cells of an entire screen to thereby generate wall charge in cells. After the ramp-up signal is applied to all the scan electrodes (Y), a ramp-down signal falling from a positive voltage lower than a peak voltage of the ramp-up signal is simultaneously applied to all the scan electrodes (Y) in a set-down duration. The ramp-down signal causes small eliminating discharge in cells thereby eliminating unnecessary charges of the wall charge and space charge generated by set-up discharge and remaining the wall charge necessary for address discharge in the cells of the entire image.

In the address period APD, a negative scan pulse (SP) is sequentially applied to scan electrodes (Y) while a positive data pulse (DP) is sequentially applied to address electrodes (X). The voltage difference between the scan pulse SP and the data pulse DP and the wall charge generated in the initialization period cause the address discharge in the cell to which the data pulse DP are applied. The wall charge is generated in the cells selected by the address discharge.

In the meanwhile, in the set-down duration and the address period APD, positive direct current (DC) voltage of the sustain voltage level Vs is applied to sustain electrodes Z.

In the sustain period SPD, sustain pulses SUSPy and SUSz are alternatively applied to the scan electrodes Y and the sustain electrodes Z. Then, as the wall charge in the cell selected by the address discharge and the sustain pulse are added, a sustain discharge is caused in the manner of surface discharge between a scan electrode (Y) and a sustain electrode (Z). Finally, after the sustain discharge is completed, eliminating ramp signal EP whose pulse width is narrow is supplied to the sustain electrode (Z) to eliminate the wall charge in the cell.

Meanwhile, in the related art, the brightness weights of the reset period RPD and the address period APD of each sub-field are identical to each other in every sub-field, whileas the brightness weight of the sustain period is increased in a ratio of $2^n$ (n=0, 1, 2, 3, 4, 5, 6, 7) at each of the sub-fields. As described above, since sustain period SPD of each sub-field gets different, a gray level of an image can be embodied. However, since these frames are arranged identically every vertical synchronization signal as shown in FIG. 5, it is limited to represent a gray level. FIG. 5 shows the case that the number of sub-fields is 12. The number of sub-fields can be modified variously according to the gray level to be embodied.

Accordingly, in order to overcome the limitation of the gray level, it has been suggested that two frames of FIGS. 6A and 6B are alternatively arranged at every vertical synchronization signal. For example, sub-fields are arranged in odd frames (or even frames) at weight ratios of 1, 6, 13, 23, 35, 51, 70, 91, 116, 145, 176 and 211 as shown in FIG. 6A, and the sub-fields are arranged in even frames (or odd frames) at weight ratios of 4, 9, 18, 29, 42, 60, 80, 103, 130, 160, 193 and 109 as shown in FIG. 6B. As described above, if the odd frames and the even frames whose brightness weights are different from each other of each sub-field are alternatively used at every vertical synchronization signal, gray level representation ability is increased two times or more as in the case that frames whose brightness weights are identical to each other are arranged. Herein, the brightness weights of the sub-field should be alternatively allocated to the odd frames and the even frames as follows: 1, 4, 6, 9, 13, 18, 23, 29, and so on.

If the brightness weights of the sub-field are alternatively allocated to the odd frames and the even frames as described above, light emission centers are not identical to each other and flicker is caused so seriously that the, image quality deteriorated. For example, if all the sub-fields of every frame are turned on, the light emission centers of the odd frames are the position of brightness weight of 211 while the light emission centers of the even frames are the position of brightness weight of 193. Accordingly, as the locations of light emission centers of both frames are different from each other, flicker is caused to affect fatally on image quality.

SUMMARY OF THE INVENTION

Accordingly, the present invention is directed to a method and an apparatus for driving a PDP that substantially obviates one or more problems due to limitations and disadvantages of the related art.

An object of the present invention is to provide a method and an apparatus for driving a PDP with image quality improved by making the light emission centers of the frames having different brightness weights be identical to each other.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, in a method for driving a PDP which has a first frame period determined by a first vertical synchronization signal and a second vertical synchronization signal, and a second frame period determined by the second vertical synchronization signal and a third vertical synchronization signal, and which displays a predetermined image by arranging a first frame, having a plurality of first weight fields during the first frame period and, at the same time, arranging a second frame having a plurality of second weight fields with brightness weights different from brightness weights of the plurality of first weight fields during the second frame period, the first frame period and the second frame period are varied differently from each other.

Variations in the first and second frame periods depend on a height of an input gray level or on a height of an average picture level.

In another aspect of the present invention, a method for driving a PDP, which displays a predetermined image by arranging a first frame having a plurality of first weight fields and, at the same time, arranging a second frame having a plurality of second weight fields with brightness weights different from brightness weights of the plurality of first weight fields, includes: determining whether a frame period is varied on the basis of order of an inputted vertical synchronization signal; varying the frame period according to whether the frame period is varied; and shifting and arranging the first and second frames in the varied frame period.

The frame period is divided into a first frame period in which the first frame is arranged and a second frame period in which the second frame is arranged.

In another aspect of the present invention, an apparatus for driving a PDP which displays a predetermined image by arranging a first frame having a plurality of first weight fields and, at the same time, arranging a second frame having a plurality of second weight fields with brightness weights different from brightness weights of the plurality of first weight fields, includes: means for determining whether a frame period is varied on the basis of order of an inputted vertical synchronization signal; means for varying the frame period according to the determining of the determining means; and means for shifting and arranging the first and second frames in the varied frame period.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

First, terms used in this specification are defined as follows.

First frame indicates an odd frame and second frame indicates an even frame. The sum of a first frame period and a second frame period are maintained constant. The first frame period indicates the length between a first vertical synchronization signal and a second vertical synchronization signal and the second frame period means the length between the second vertical synchronization signal and a third vertical synchronization signal.

Figure 1:
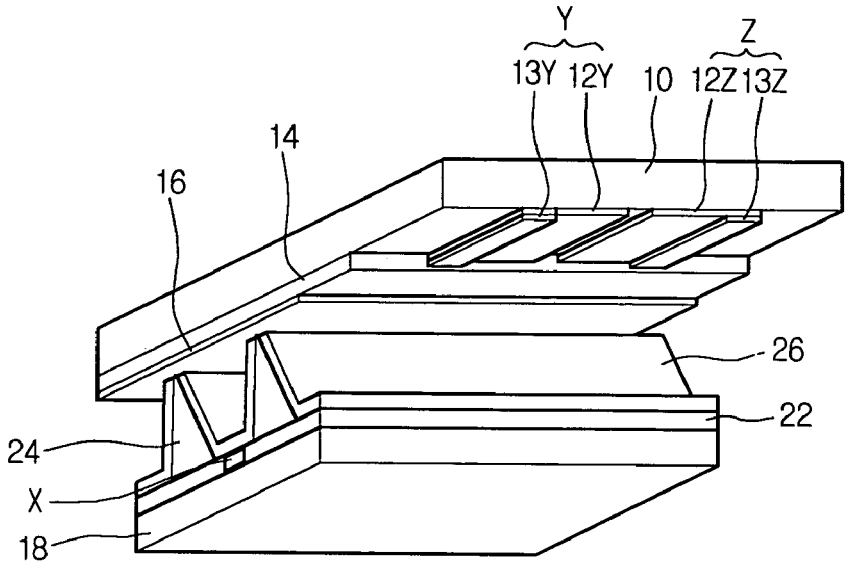
Fig.1 Related Art
FIG. 1 is a perspective view of a discharge cell of a three electrode AC surface discharge type PDP.
Figure 2:
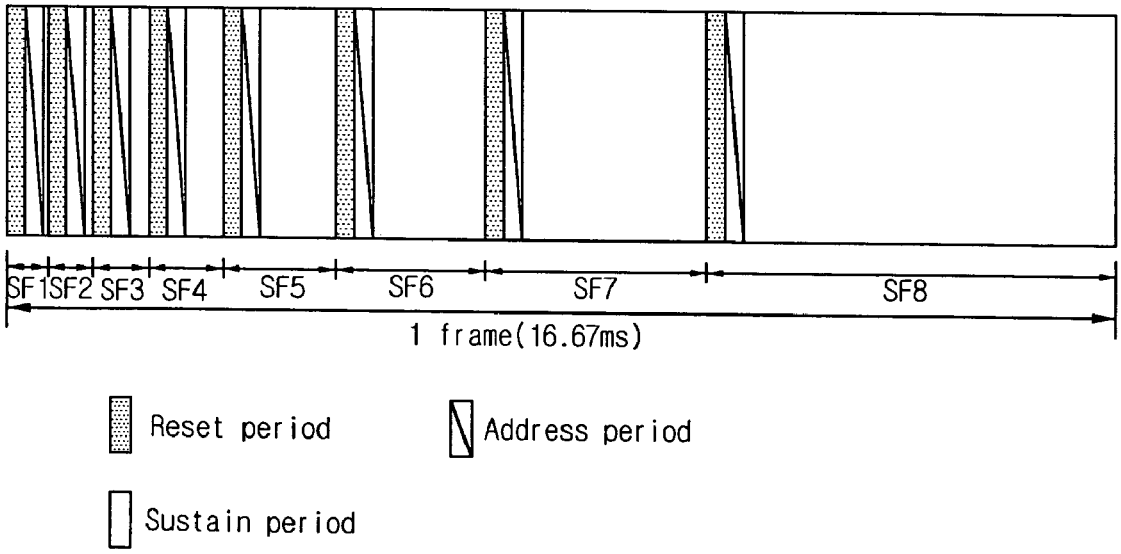
Fig.2 Related Art
FIG. 2 shows a frame consisting of eight general sub-fields.
Figure 3:
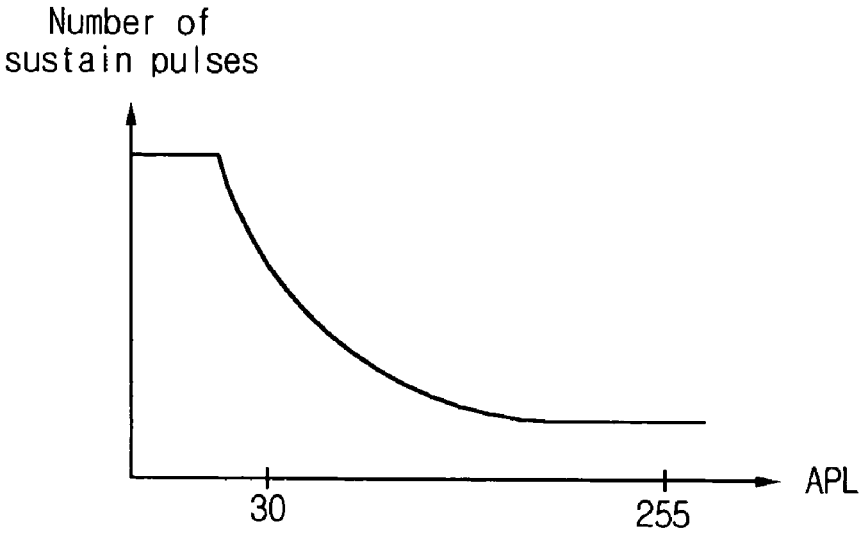
Fig.3 Related Art
FIG. 3 is a graph of the number of sustain pulses according to a general APL.
Figure 4:
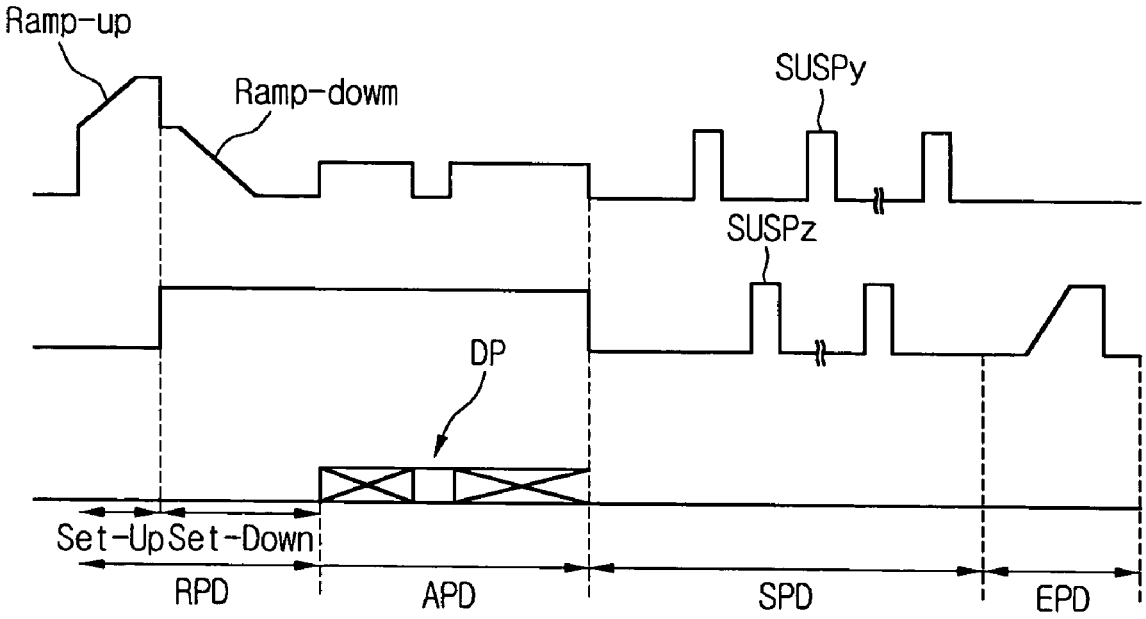
Fig.4 Related Art
FIG. 4 shows a voltage waveform in a conventional method of driving a PDP.
Figure 5:
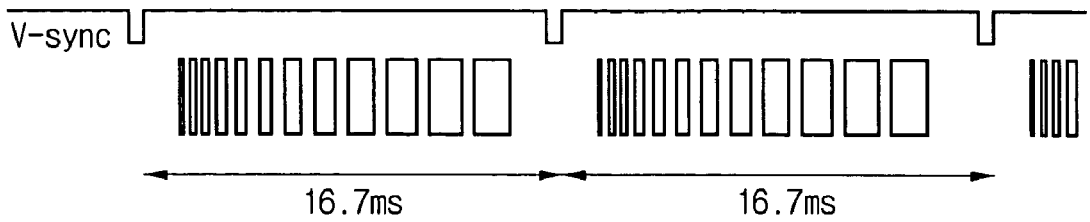
Fig.5 Related Art
FIG. 5 shows arranged frames in an identical frame period according to the related art.
Figure 6A:
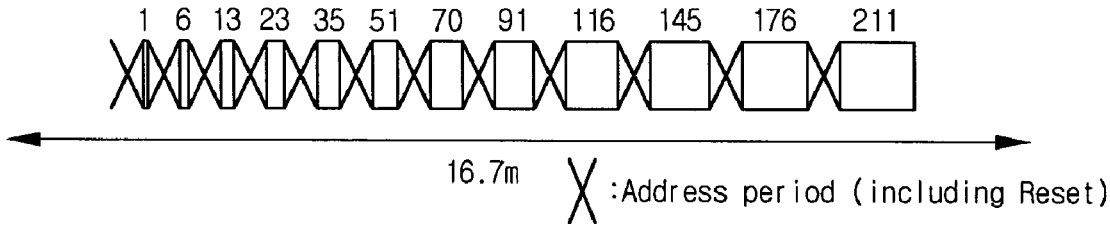
Fig.6A Related Art
FIGS. 6A and 6B show two frames having brightness weights different from each other according to the related art.
Figure 6B:
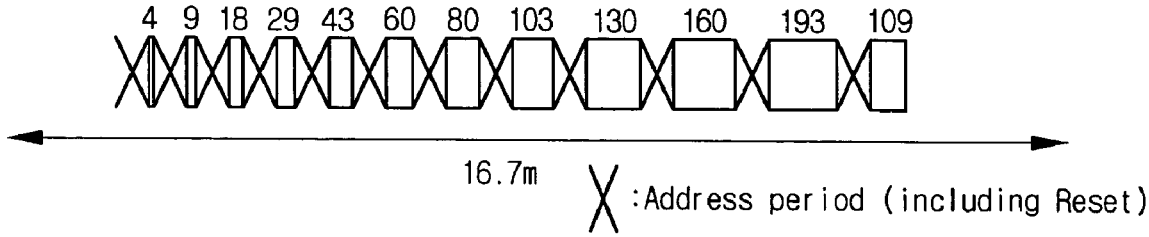
Fig.6B Related Art
Figure 7:
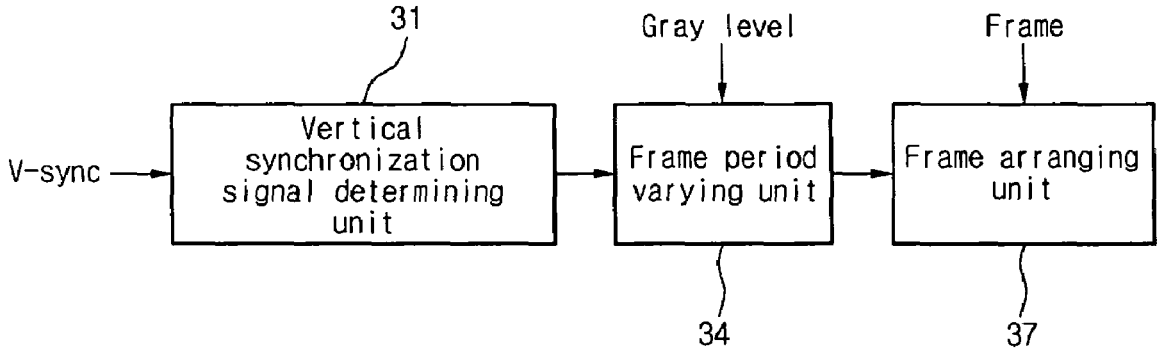
FIG. 7 shows an apparatus for driving a PDP according to a first embodiment of the present invention.

FIG. 7 shows an apparatus for driving a PDP according to a first embodiment of the present invention.

In the apparatus for driving a PDP according to a first embodiment of the present invention, two frames whose brightness weights are different from each other are alternatively arranged at every vertical synchronization signal Vsync so as to increase gray level representation.

Referring to FIG. 7, an apparatus for driving a PDP includes a vertical synchronization signal determining unit 31, a frame period varying unit 34 and a frame arranging unit 37.

The vertical synchronization signal determining unit 31 determines whether a frame period is varied on the basis of order of an inputted vertical synchronization signal. A counter may be used for this determination. For example, the first inputted vertical synchronization signal may be counted as odd, and next inputted vertical synchronization signal may be counted as even. As described above, the vertical synchronization signal determining unit 31 determines whether the inputted vertical synchronization signal is odd or even and supplies the frame period varying unit 34 with the determination result.

The frame period varying unit 34 varies the frame period according to the determination result supplied from the vertical synchronization signal determining unit 31. Herein, the frame period means the length between the vertical synchronization signal and a next vertical synchronization signal. In other words, the frame period varying unit 34 varies the frame period between the vertical synchronization signal and the next vertical synchronization signal on the basis of the supplied determination result.

For example, in the odd frame, sub-fields may be arranged at a ratio of weights of 1, 6, 13, 23, 35, 51, 70, 91, 116, 145, 176, and 211. In the even frame, sub-fields may be arranged at a ratio of weights of 4, 9, 18, 29, 43, 60, 80, 103, 130, 160, 193, and 109. Of course, the odd frame and even frame may be changed with each other. In the related art, since the frame period is constant, the locations of light emission centers of both frames are different from each other. Flickering is hence caused to fatally effect an image's quality.

In the present invention, the light emission centers are made identical to each other according to whether the vertical synchronization signal is odd or even. For example, the frame period is increased for the odd frame and decreased for the even frame thereby making the light emission centers be identical to each other. As the frame period is varied, both frame arranged in the frame period are simultaneously shifted. In other words, when the frame period is increased, the odd frame is shifted left, and when the frame period is decreased, the even frame is shifted right.

More detailed description will be made. When the vertical synchronization signal inputted from the vertical synchronization signal determining unit 31 is counted odd, the frame period varying unit 34 increases the frame period. In contrast, when the vertical synchronization signal inputted from the vertical synchronization signal determining unit 31 is counted even, the frame period varying unit 34 decreases the frame period. Herein, the frame period can be easily varied by adjusting the length between a vertical synchronization signal and a second vertical synchronization signal. For example, when the first vertical synchronization signal is counted as odd, since the frame period (the first frame period) should be increased, the frame period varying unit 34 outputs the first vertical synchronization signal and then outputs the second vertical synchronization signal after the time at which the second vertical synchronization signal should be outputted. When the first vertical synchronization signal is counted odd, the second vertical synchronization signal is automatically counted even. In this case, since the frame period (the second frame period) should be shortened, the frame period varying unit 34 outputs the second vertical synchronization signal and then outputs a third vertical synchronization signal that is next synchronization signal before the time at which the third vertical synchronization signal should be outputted. Herein, it is desired that the sum of the first frame period and the second frame period should be maintained constant.

The frame arranging unit 37 arranges a predetermined frame in the frame period varied by the frame period varying unit 34. Herein, the frame is shifted according to the varied frame period. In other words, if the varied frame period is increased, the frame is shifted left. If the varied frame period is decreased, the frame is shifted right.

Meanwhile, when the apparatus for driving the PDP according to a first embodiment of the present invention, variation of the frame period can be adjusted considering the gray level. In other words, variation of the frame period in a high gray level may be two or three times as large as variation of the frame period in a low gray level.

In general, flickering due to different light emission centers is very small at low gray level while flickering due to different light emission centers can fatally affect on image quality at high gray level. Accordingly, the frame period of the high gray level should be varied longer or shorter than the frame period of the low gray level.

Referring to FIGS. 8 through 11B, the method for varying the frame period with considering gray level will be described.

Figure 8:
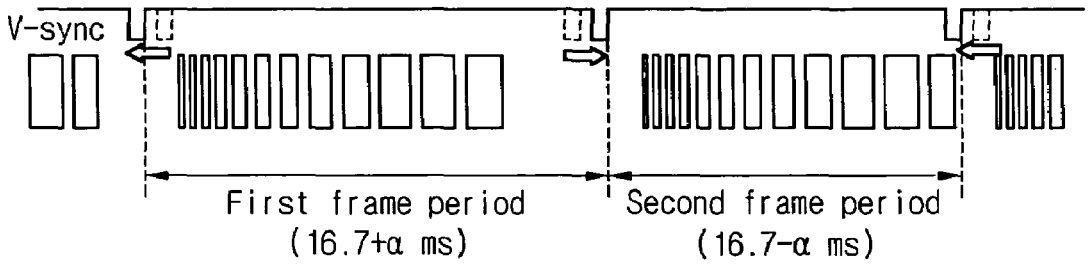
FIG. 8 shows frames in the frame period varied by α when high gray level is represented according to a first embodiment of the present invention.
Figure 9A:
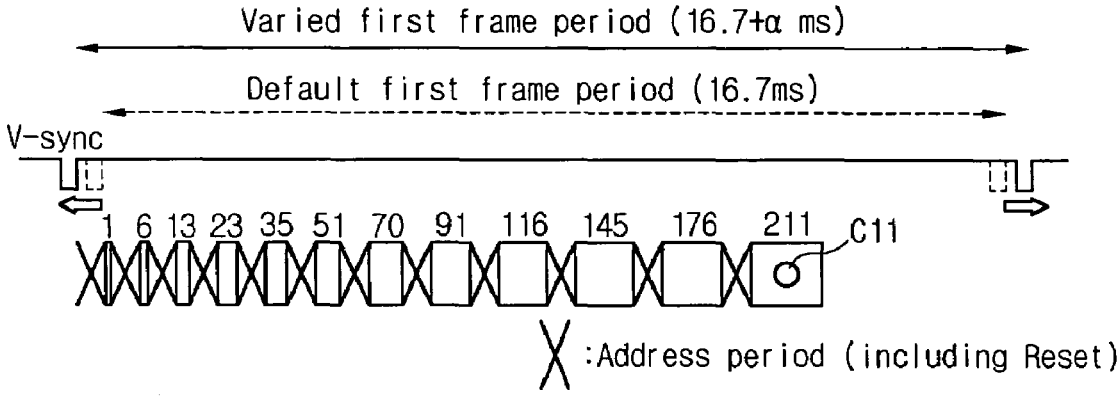
FIGS. 9A and 9B show that light emission centers are identical to each other when frames are arranged as shown in FIG. 8.
Figure 9B:
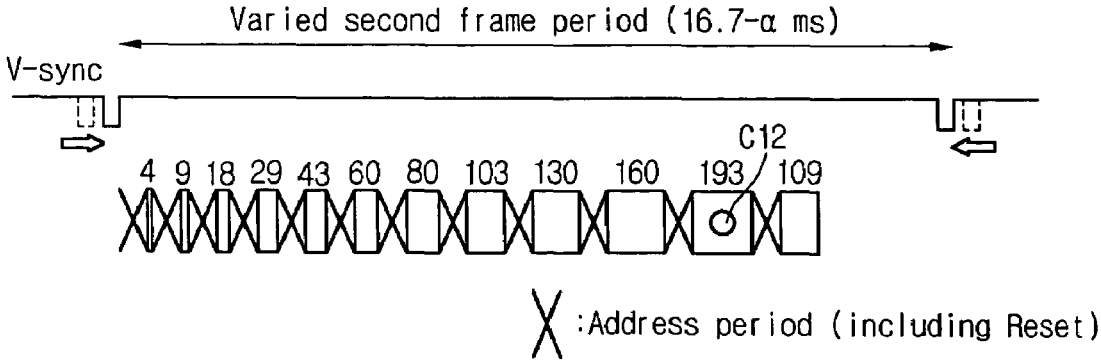
Figure 10:
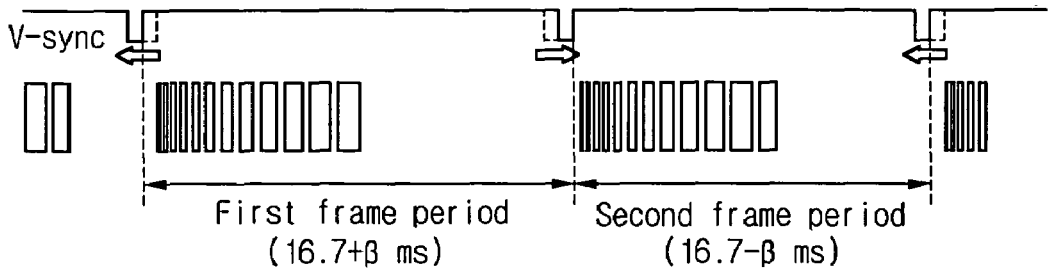
FIG. 10 shows frames in the frame period varied by β when low gray level is represented according to a first embodiment of the present invention.
Figure 11A:
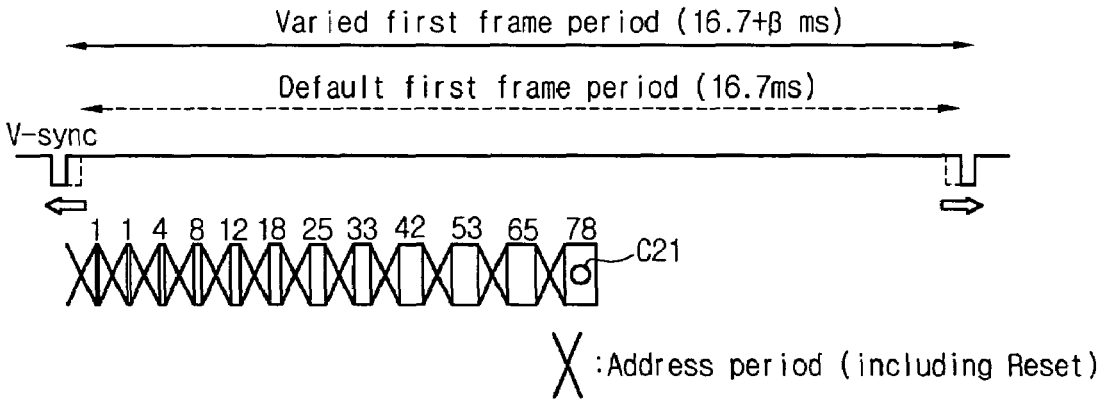
FIGS. 11A and 11B show that light emission centers are identical to each other when frames are arranged as shown in FIG. 10.
Figure 11B:
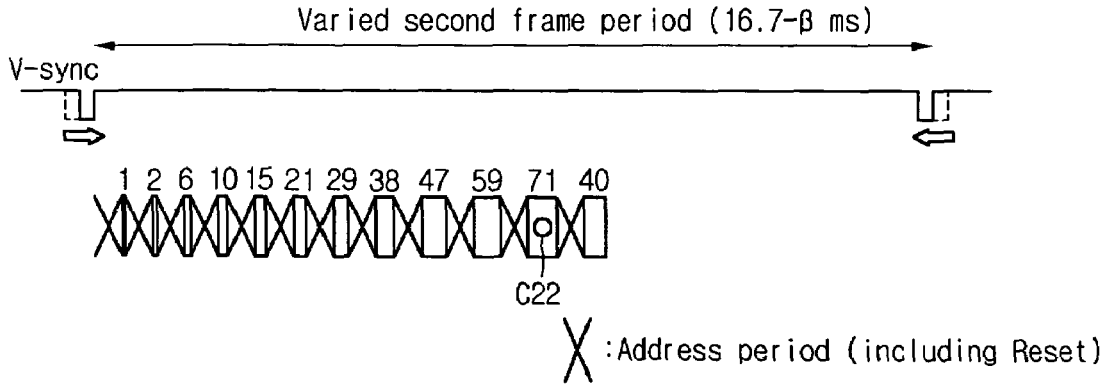

FIG. 8 shows frames in the frame period varied by a when high gray level is represented according to a first embodiment of the present invention. FIGS. 9A and 9B show that light emission centers are identical to each other when frames are arranged as shown in FIG. 8. FIG. 10 shows frames in the frame period varied by β when low gray level is represented according to a first embodiment of the present invention. FIGS. 11A and 11B show that light emission centers are identical to each other when frames are arranged as shown in FIG. 10.

In the case of high gray level, as shown in FIG. 8, the first frame period is increased by α and the second frame period is decreased by α. Herein, it is desired that α is set to be equal to less than 500 μsec. In other words, the first frame period is evenly increased to both sides by α/2 so that the first frame period is entirely increased by α. The second frame period is evenly decreased from both sides by α/2 so that the second frame period entirely is decreased by α.

As each frame period is varied, the first and second frames arranged in each frame period are shifted. When the frame period is increased as the first frame period, the first frame is arranged to shift left to the first vertical synchronization signal as much as the first frame period is increased. In contrast, when the frame period is decreased as the second frame period, the second frame is arranged to shift right to the third vertical synchronization signal as much as the second frame period is decreased.

More detailed description will be made. As shown in FIGS. 9A and 9B, the light emission centers C11 of the first frame is positioned to lag the light emission centers C12 of the second frame in the time domain. In this case, if the first frame period is increased, the first frame is shifted left and the light emission center C11 of the first frame is also shifted left. In contrast, if the second frame period is decreased, the second frame is shifted right and the light emission center C12 of the second frame is also shifted right. Accordingly, if the first frame period is increased and the second frame period is decreased, the light emission centers C11 and C12 of the first and second frames become identical to each other so that flickering can be eliminated and therefore brightness can be enhanced and picture quality can be improved.

In the meanwhile, in the case of low gray level, as shown in FIG. 10, the first frame period is increased by β and the second frame period is decreased by β. Herein, it is desired that β is set to be equal to less than 100 μsec. In other words, the first frame period is evenly increased to both sides by β/2 so that the first frame period is entirely increased by β. The second frame period is evenly decreased from both sides by β/2 so that the second frame period entirely is decreased by β.

As each frame period is varied, the first and second frames arranged in each frame period are shifted. When the frame period is increased as the first frame period, the first frame is arranged to shift left to the first vertical synchronization signal as much as the first frame period is increased. In contrast, when the frame period is decreased as the second frame period, the second frame is arranged to shift right to the third vertical synchronization signal as much as the second frame period is decreased.

More detailed description will be made. As shown in FIGS. 11A and 11B, the light emission centers C21 of the first frame is positioned to lag the light emission centers C22 of the second frame in the time domain. In this case, if the first frame period is increased, the first frame is shifted left and the light emission center C21 of the first frame is also shifted left. In contrast, if the second frame period is decreased, the second frame is shifted right and the light emission center C22 of the second frame is also shifted right. Accordingly, if the first frame period is increased and the second frame period is decreased, the light emission centers C21 and C22 of the first and second frames become identical to each other so that flickering can be eliminated and therefore brightness can be enhanced and picture quality can be improved.

As described above, variations of the first and second frame periods depend on height of the gray level. In other words, in the case of a high gray level, variation degree a can be set to be substantially five times as large as variation degree β of low gray level.

Meanwhile, variations of the first and second frame periods depend on APL instead of the gray level.

Figure 12:
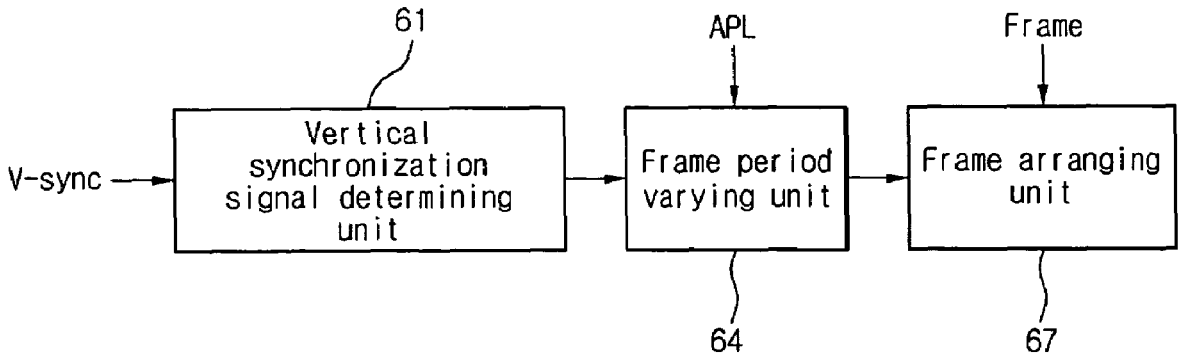
FIG. 12 shows an apparatus for driving a PDP according to a second embodiment of the present invention.

FIG. 12 shows an apparatus for driving a PDP according to a second embodiment of the present invention.

Referring to FIG. 12, the apparatus for driving a PDP according to a second embodiment of the present invention includes a vertical synchronization signal determining unit 61, a frame period varying unit 64 and a frame arranging unit 67. Herein the vertical synchronization signal determining unit 61 is identical to vertical synchronization signal determining unit 31 described above.

The frame period varying unit 64 varies the frame period according to the determination result supplied from the vertical synchronization signal determining unit 61. Herein, the frame period means the length between the vertical synchronization signal and a next vertical synchronization signal. In other words, the frame period varying unit 64 varies the frame period between the vertical synchronization signal and the next vertical synchronization signal on the basis of the supplied determination result. Herein, the frame period varying unit 64 can set the variation degree of the frame period varied according to APL.

The frame arranging unit 67 arranges a predetermined frame in the frame period varied by the frame period varying unit 64. Herein, the frame is shifted according to the varied frame period. In other words, if the varied frame period is increased, the frame is shifted left. If the varied frame period is decreased, the frame is shifted right.

Referring to FIGS. 13 through 16, the method for varying the frame period according to APL will be described.

Figure 13:
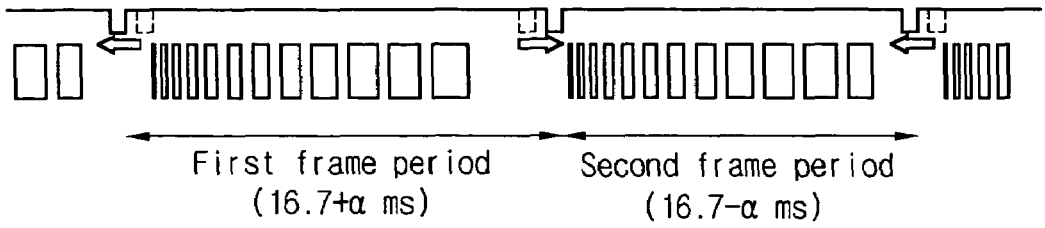
FIG. 13 shows frames in the frame period varied by α when APL is large according to a second embodiment of the present invention.
Figure 14A:
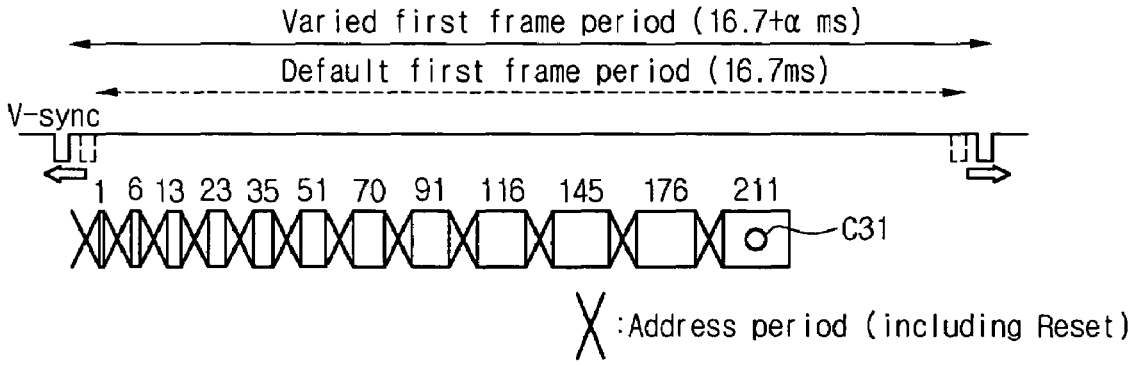
FIGS. 14A and 14B show that light emission centers are identical to each other when frames are arranged as shown in FIG. 13.
Figure 14B:
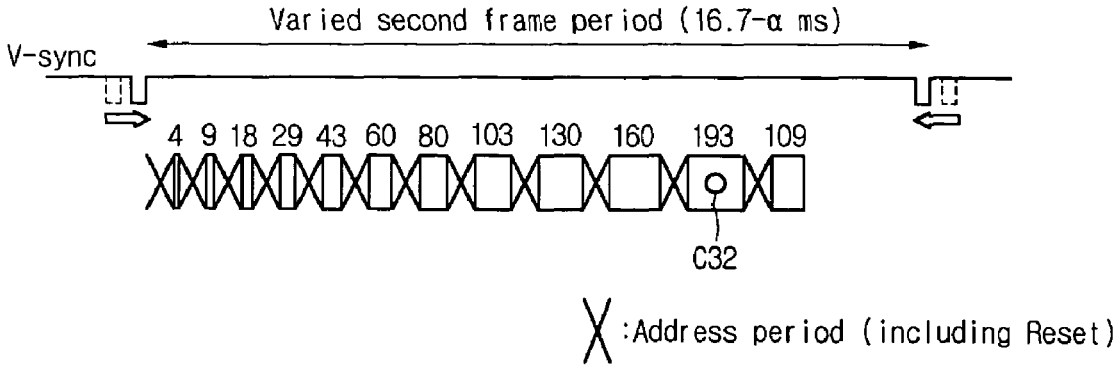
Figure 15:
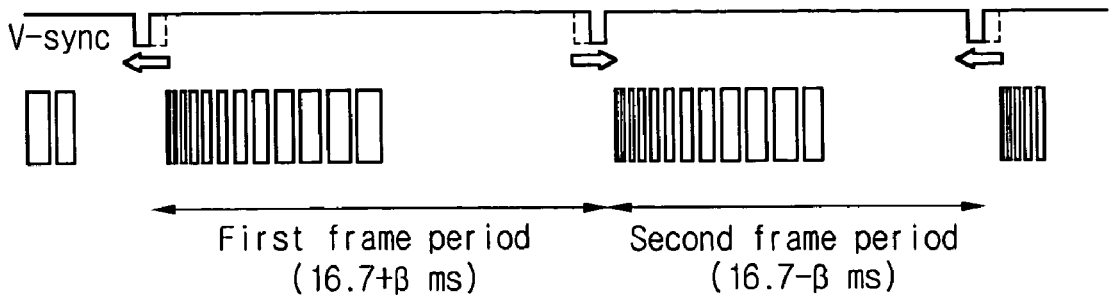
FIG. 15 shows frames in the frame period varied by β when APL is small according to a second embodiment of the present invention.
Figure 16A:
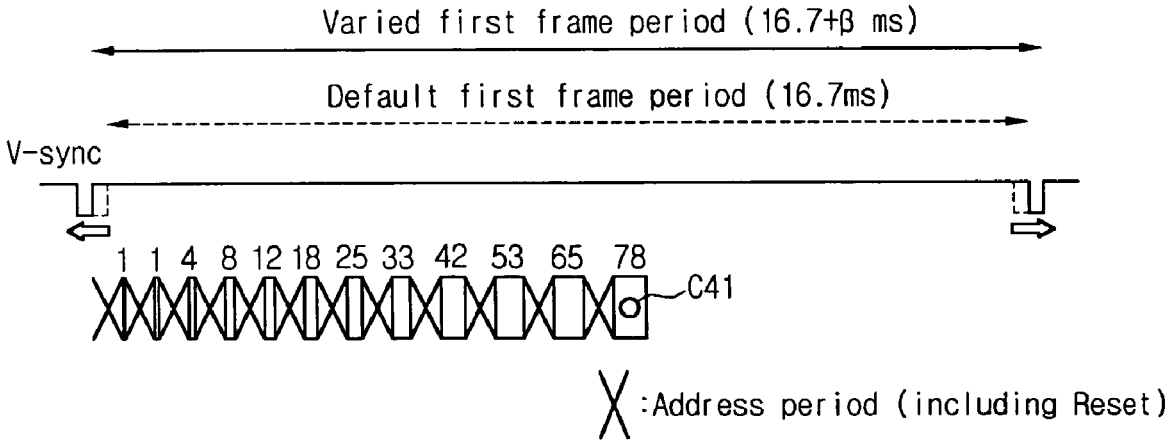
FIGS. 16A and 16B show that light emission centers are identical to each other when frames are arranged as shown in FIG. 15.
Figure 16B:
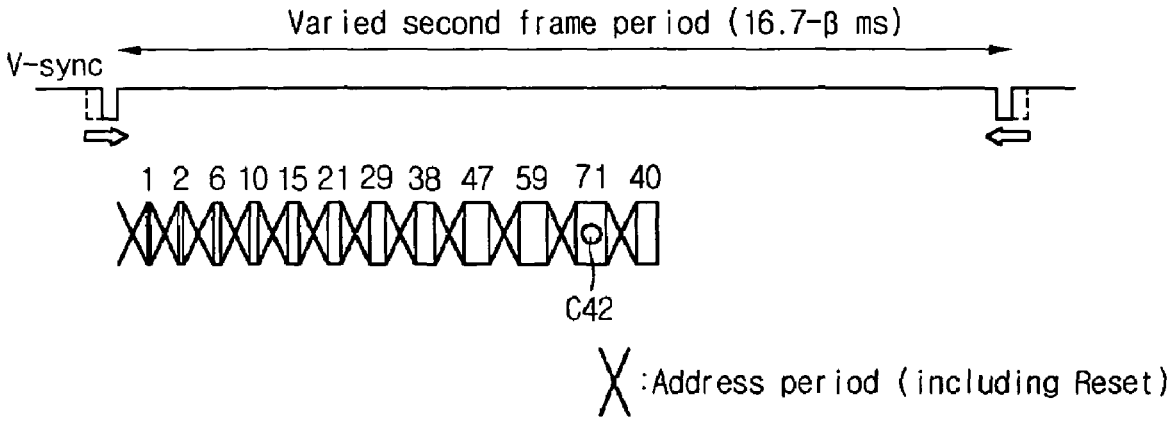

FIG. 13 shows frames in the frame period varied by a when APL is large according to a second embodiment of the present invention. FIGS. 14A and 14B show that light emission centers are identical to each other when frames are arranged as shown in FIG. 13. FIG. 15 shows frames in the frame period varied by β when APL is small according to a second embodiment of the present invention. FIGS. 16A and 16B show that light emission centers are identical to each other when frames are arranged as shown in FIG. 15.

In general, flickering due to different light emission centers is very small at small APL while flickering due to different light emission centers can fatally affect on image quality at large APL. Accordingly, the frame period of the large APL should be varied longer or shorter than the frame period of the small APL.

In the case of large APL, as shown in FIG. 13, the first frame period is increased by α and the second frame period is decreased by α. Herein, it is desired that α is set to be equal to less than 500 μsec. In other words, the first frame period is evenly increased to both sides by α/2 so that the first frame period is entirely increased by α. The second frame period is evenly decreased from both sides by α/2 so that the second frame period entirely is decreased by α.

As each frame period is varied, the first and second frames arranged in each frame period are shifted. When the frame period is increased as the first frame period, the first frame is arranged to shift left to the first vertical synchronization signal as much as the first frame period is increased. In contrast, when the frame period is decreased as the second frame period, the second frame is arranged to shift right to the third vertical synchronization signal as much as the second frame period is decreased.

More detailed description will be made. As shown in FIGS. 14A and 14B, the light emission centers C31 of the first frame is positioned to lag the light emission centers C32 of the second frame in the time domain. In this case, if the first frame period is increased, the first frame is shifted left and the light emission center C31 of the first frame is also shifted left. In contrast, if the second frame period is decreased, the second frame is shifted right and the light emission center C32 of the second frame is also shifted right. Accordingly, if the first frame period is increased and the second frame period is decreased, the light emission centers C31 and C32 of the first and second frames become identical to each other so that flickering can be eliminated and therefore brightness can be enhanced and picture quality can be improved.

In the meanwhile, in the case of low APL, as shown in FIG. 15, the first frame period is increased by β and the second frame period is decreased by β. Herein, it is desired that β is set to be equal to less than 100 μsec. In other words, the first frame period is evenly increased to both sides by β/2 so that the first frame period is entirely increased by β. The second frame period is evenly decreased from both sides by β/2 so that the second frame period entirely is decreased by β.

As each frame period is varied, the first and second frames arranged in each frame period are shifted. When the frame period is increased as the first frame period, the first frame is arranged to shift left to the first vertical synchronization signal as much as the first frame period is increased. In contrast, when the frame period is decreased as the second frame period, the second frame is arranged to shift right to the third vertical synchronization signal as much as the second frame period is decreased.

More detailed description Will be made. As shown in FIGS. 16A and 16B, the light emission centers C41 of the first frame is positioned to lag the light emission centers C42 of the second frame in the time domain. In this case, if the first frame period is increased, the first frame is shifted left and the light emission center C41 of the first frame is also shifted left. In contrast, if the second frame period is decreased, the second frame is shifted right and the light emission center C42 of the second frame is also shifted right. Accordingly, if the first frame period is increased and the second frame period is decreased, the light emission centers C41 and C42 of the first and second frames become identical to each other so that flickering can be eliminated and therefore brightness can be enhanced and picture quality can be improved.

As described above, variations of the first and second frame periods depend on APL. In other words, in the case of a high gray level, variation degree α can be set to be substantially five times as large as variation degree β of the low gray level.

Meanwhile, such a driving method can be applied not only to the case of 50 Hz mode or 60 Hz mode but also to any other frequency modes. This driving method adopts dithering usually to represent gray level.

As described above, the apparatus for driving the PDP according to the present invention varies a frame period determined by two vertical synchronization signal to make the light emission centers be identical to each other so that flickering caused when two frames consisting of brightness weights different from each other are alternatively arranged is suppressed to enhance brightness and improve image quality.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A method for driving a plasma display panel (PDP), which has a first frame period determined by a first vertical synchronization signal and a second vertical synchronization signal, and a second frame period determined by the second vertical synchronization signal and a third vertical synchronization signal, and which displays a predetermined image by arranging a first frame having a plurality of first weight fields during the first frame period and, at the same time, arranging a second frame having a plurality of second weight fields with brightness weights different from brightness weights of the plurality of first weight fields during the second frame period, the method comprising:

varying the first and second frame periods, wherein the first frame period and the second frame period are varied differently from each other; and shifting the first and second frames as the first and second frame periods are varied.

2. The method according to claim 1, wherein the first frame period and the second frame period are relatively varied according to which of the brightness weights of the plurality of first weight fields and the brightness weights of the plurality of second weight fields are larger.

3. The method according to claim 1, wherein a sum of the varied first and second frame period is maintained constant.

4. The method according to claim 1, wherein the first and second frame periods are varied depending on a value of an input gray level.

5. The method according to claim 1, wherein the first and second frame periods are varied depending on a value of an average picture level.

6. The method of claim 1, wherein the times at which the first, second and third vertical synchronization signals are output are varied, to thereby vary the durations of the first and second frame periods.

7. The method of claim 6, wherein the amount by which the first, second and third vertical first vertical synchronization signals are varied depends on a brightness value of the first and second frames.

8. The method of claim 7, wherein the first, second and third vertical synchronization signals are varied more when the first and second frames have a high brightness value.

9. The method of claim 6, wherein the times at which the first, second and third vertical synchronization signals are output are varied such that when a first frame period is lengthened by a predetermined amount, a consecutive second frame period is shortened by the same predetermined amount, and such that when a first frame period is shortened by a predetermined amount, a consecutive second frame period is lengthened by the same predetermined amount.

10. A method of driving a plasma display panel (PDP), which displays a predetermined image by arranging a first frame which is displayed for a first frame period and that has a plurality of first weight fields and, and the same time arranging a second frame that is displayed for a second frame period that has a plurality of second weight fields with brightness weights different from brightness weights of the plurality of first weight fields, the method comprising:

determining whether a frame period is to be varied by varying the timing of the inputted vertical synchronization signals;

varying the first and second frame periods if it is determined that a frame period is to be varied; and shifting and arranging the first and second frames if it is determined that a frame period is to be varied.

11. The method according to claim 10, wherein each frame period is an interval between a first vertical synchronization signal and a next vertical synchronization signal.

12. The method according to claim 10, wherein each vertical synchronization signal has an order of an odd vertical synchronization signal or an order of an even vertical synchronization signal.

13. The method according to claim 10, wherein, when it is determined that a first frame period is to be increased, a next frame period is relatively decreased.

14. The method according to claim 10, wherein the first and second frame periods are varied depending on a value of an input gray level.

15. The method according to claim 10, wherein the first and second frame periods are varied depending on a value of an average picture level.

16. The method according to claim 10, wherein, when the first frame period is increased, the first frame period is shifted left.

17. The method according to claim 10, wherein, when the first frame period is decreased, the first frame period is shifted right.

18. The method of claim 10, wherein when the first and second frame period are varied, the total duration of the first and second frame periods is equal to the total duration of the unvaried first and second frame period.

19. The method of claim 10, wherein when the first and second frame periods are varied, one of the first and second frame periods is lengthened by the same amount that the other of the first and second frame periods is shortened.

20. An apparatus for driving a plasma display panel (PDP), which displays a predetermined image by arranging a first frame that is displayed for a first frame period and that has a plurality of first weight fields, and at the same time arranging a second frame that is displayed for a second frame period that has a plurality of second weight fields with brightness weights different from brightness weights of the plurality of first weight fields, the apparatus comprising:

means for determining whether a frame period is to be varied by varying the timing of inputted vertical synchronization signals;

means for varying the first and second frame period if the determining means determines that a frame period is to be varied; and means for shifting and arranging the first and second frames if its determined that a frame period is to be varied.

21. The apparatus according to claim 20, wherein each frame period is an interval between a first vertical synchronization signal and a next vertical synchronization signal.

22. The apparatus according to claim 20, wherein each vertical synchronization signal has an order of an odd vertical synchronization signal or an order of an even vertical synchronization signal.

23. The apparatus according to claim 20, wherein the varying means varies the first and second frame periods according to a value of an input gray level.

24. The apparatus according to claim 20, wherein the varying means varies the first and second frame periods according to a value of an average picture level.

25. The apparatus according to claim 20, wherein the varying means decreases a second frame period relatively when a first period is increased.

* * * * *